US012037852B2

(12) United States Patent
Kruspe et al.

(10) Patent No.: US 12,037,852 B2
(45) Date of Patent: Jul. 16, 2024

(54) EROSION PREDICTION FOR DOWNHOLE TOOLS

(71) Applicants: Thomas Kruspe, Wietzendorf (DE); Peter Rottengatter, Celle (DE)

(72) Inventors: Thomas Kruspe, Wietzendorf (DE); Peter Rottengatter, Celle (DE)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/858,131

(22) Filed: Jul. 6, 2022

(65) Prior Publication Data

US 2023/0012069 A1 Jan. 12, 2023

Related U.S. Application Data

(60) Provisional application No. 63/218,612, filed on Jul. 6, 2021.

(51) Int. Cl.
*E21B 12/02* (2006.01)
*E21B 47/00* (2012.01)

(52) U.S. Cl.
CPC ..... *E21B 12/02* (2013.01); *E21B 47/006* (2020.05)

(58) Field of Classification Search
CPC .... E21B 12/02; E21B 41/0085; E21B 47/006; E21B 47/13
See application file for complete search history.

(56) References Cited

U.S. PATENT DOCUMENTS 2,770,773 A * 11/1956 Cooley ..... E21B 47/092 324/346
3,058,532 A * 10/1962 Alder ..... E21B 12/02 175/25
9,004,195 B2 4/2015 Regener et al.
2011/0227565 A1 9/2011 Morton
2012/0043980 A1 2/2012 Davies
2012/0152617 A1 6/2012 Hunt et al.
2014/0290351 A1* 10/2014 Kruspe ..... E21B 12/02 73/152.47
2017/0038493 A1* 2/2017 Wu ..... E21B 47/006

(Continued)

OTHER PUBLICATIONS

International Search Report for International Application No. PCT/US2022/035420; Date of Search: Oct. 17, 2022; 3 pages.

(Continued)

*Primary Examiner* — Brad Harcourt
(74) *Attorney, Agent, or Firm* — CANTOR COLBURN LLP

(57) ABSTRACT

Downhole monitoring systems are described. The systems include a downhole string disposed in a borehole, the string having a downhole tool and the borehole has fluid therein. A sacrificial electrical sensor element is arranged in or on the string. The sacrificial electrical sensor element includes magnetic material at least partially exposed to the fluid and at least one coil arranged in magnetic communication with the magnetic material. A controller is configured to provide an electrical current into the coil, measure an electrical property of the coil that is based on the magnetic material in magnetic communication with the coil, and determine a wear state of the downhole tool based on the measured electrical property.

20 Claims, 7 Drawing Sheets

(56) References Cited

U.S. PATENT DOCUMENTS

| | | | | |
|---|---|---|---|---|
| 2017/0101865 | A1* | 4/2017 | Khalaj Amineh | E21B 47/08 |
| 2018/0106922 | A1 | 4/2018 | Leuenberger et al. | |
| 2020/0003668 | A1* | 1/2020 | Schwalbach | E01C 23/065 |
| 2020/0309673 | A1 | 10/2020 | Elder | |

OTHER PUBLICATIONS

Written Opinion for International Application No. PCT/US2022/035420; Date of Search: Oct. 17, 2022; 3 pages.

* cited by examiner

EROSION PREDICTION FOR DOWNHOLE TOOLS

CROSS-REFERENCE TO RELATED APPLICATIONS

This application claims the benefit of U.S. Provisional Application No. 63/218,612, filed Jul. 6, 2021, the disclosure of which is incorporated herein by reference in its entirety.

BACKGROUND

1. Field of the Invention

The present invention generally relates to downhole components and sensors for monitoring environmental damage of downhole components.

2. Description of the Related Art

Boreholes are drilled deep into the earth for many applications such as carbon dioxide sequestration, geothermal production, and hydrocarbon exploration and production. In all of the applications, the boreholes are drilled such that they pass through or allow access to a material (e.g., a gas or fluid) contained in a formation located below the earth's surface. Different types of tools and instruments may be disposed in the boreholes to perform various tasks and measurements.

In operation, the downhole components may be subject to vibrations and various temperatures that can cause wear, fatigue, and/or failure of such components. Furthermore, the combination of high temperatures and vibrations may act synergistically to cause more damage than either of these separately. Thus, it is advantageous to provide monitoring of such downhole components to determine whether the components are approaching a critical amount of wear and to estimate the remaining lifetime of the component.

SUMMARY

Disclosed herein are systems and sensor elements for indirect monitoring of corrosive or other environmental damage to operational downhole tools. Downhole monitoring systems of embodiments of the present disclosure include a downhole string disposed in a borehole, the downhole string having a downhole tool and the borehole has fluid therein. A sacrificial electrical sensor element is arranged in or on the downhole string, the sacrificial electrical sensor element having magnetic material at least partially exposed to the fluid and at least one coil is arranged in magnetic communication with the magnetic material. A controller is configured to provide an electrical current into the at least one coil, measure an electrical property of the at least one coil, wherein the electrical property of the at least one coil is based on the magnetic material in magnetic communication with the at least one coil and determine a wear state of the downhole tool based on the measured electrical property.

Disclosed herein are sacrificial electrical sensor systems for monitoring downhole wear. The sacrificial electrical sensor systems for monitoring downhole wear in accordance with some embodiments includes magnetic material configured to be at least partially exposed to a fluid, the magnetic material configured to attach to a downhole string and the downhole string includes a downhole tool. At least one coil is arranged in magnetic communication with the magnetic material. A controller is electrically connected to the at least one coil, the controller configured to provide an electrical current into the at least one coil, measure an electrical property of the at least one coil, wherein the electrical property of the at least one coil is based on the magnetic material in magnetic communication with the at least one coil, and determine a wear state of the downhole tool based on the measured electrical property.

Disclosed herein are methods for monitoring components disposed in downhole environments. Methods for monitoring components disposed in downhole environments in accordance with embodiments of the present disclosure include disposing a downhole string in a borehole, the downhole string comprising a downhole tool, wherein the borehole has fluid therein, the downhole string comprising a sacrificial electrical sensor element in or on the downhole string, wherein the sacrificial electrical sensor element comprises magnetic material at least partially exposed to the fluid and at least one coil arranged in magnetic communication with the magnetic material; supplying an electrical current into the at least one coil; measuring an electrical property of the at least one coil, wherein the electrical property of the at least one coil is based on the magnetic material in magnetic communication with the at least one coil; determining a wear state of the downhole tool based on the measured electrical property; and performing an operational action based on the wear state.

BRIEF DESCRIPTION OF THE DRAWINGS

The subject matter, which is regarded as the invention, is particularly pointed out and distinctly claimed in the claims at the conclusion of the specification. The foregoing and other features and advantages of the invention are apparent from the following detailed description taken in conjunction with the accompanying drawings, wherein like elements are numbered alike, in which:

DETAILED DESCRIPTION

Figure 1:
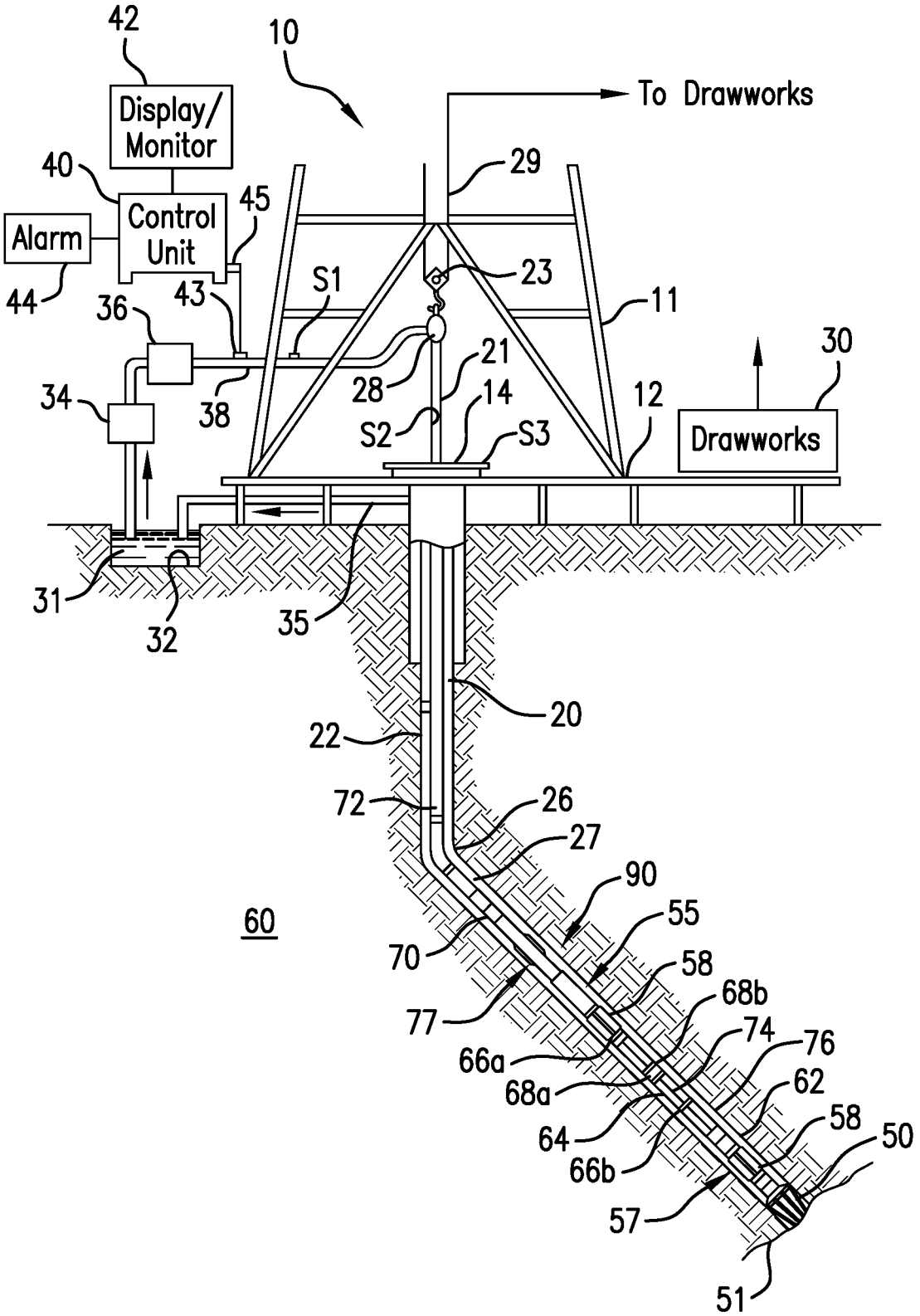
FIG. 1 is an example of a system for performing downhole operations that can employ embodiments of the present disclosure.

FIG. 1 shows a schematic diagram of a system for performing downhole operations. As shown, the system is a drilling system 10 that includes a drill string 20 having a drilling assembly 90, also referred to as a bottomhole assembly (BHA), conveyed in a borehole 26 penetrating an earth formation 60. The drilling system 10 includes a conventional derrick 11 erected on a floor 12 that supports a rotary table 14 that is rotated by a prime mover, such as an electric motor (not shown), at a desired rotational speed. The drill string 20 includes a drilling tubular 22, such as a drill pipe, extending downward from the rotary table 14 into the borehole 26.

A disintegrating tool 50, such as a drill bit attached to the end of the BHA 90, disintegrates the geological formations when it is rotated to drill the borehole 26. The drill string 20 is coupled to surface equipment such as systems for lifting, rotating, and/or pushing, including, but not limited to, a drawworks 30 via a kelly joint 21, swivel 28 and line 29 through a pulley 23. In some embodiments, the surface equipment may include a top drive (not shown). During the drilling operations, the drawworks 30 is operated to control the weight on bit, which affects the rate of penetration. The operation of the drawworks 30 is well known in the art and is thus not described in detail herein.

During drilling operations, a suitable drilling fluid 31 (also referred to as the "mud") from a source or mud pit 32 is circulated under pressure through the drill string 20 by a mud pump 34. The drill string comprises an inner bore that allows drilling fluid to pass the drill string. The drilling fluid 31 passes into the drill string 20 via a desurger 36, fluid line 38 and the kelly joint 21. The drilling fluid 31 is discharged at the borehole bottom 51 through an opening in the disintegrating tool 50. The drilling fluid 31 circulates uphole through the annular space 27 between the drill string 20 and the borehole 26 and returns to the mud pit 32 via a return line 35. A sensor 51 in the line 38 provides information about the fluid flow rate. A surface torque sensor S2 and a sensor S3 associated with the drill string 20 respectively provide information about the torque and the rotational speed of the drill string. Additionally, one or more sensors (not shown) associated with line 29 are used to provide the hook load of the drill string 20 and about other desired parameters relating to the drilling of the borehole 26. The system may further include one or more downhole sensors 70 located on the drill string 20 and/or the BHA 90.

In some applications the disintegrating tool 50 is rotated by only rotating the drill pipe 22. However, in other applications, a drilling motor 55 (mud motor) disposed in the drilling assembly 90 is used to rotate the disintegrating tool 50 and/or to superimpose or supplement the rotation of the drill string 20. In either case, the rate of penetration (ROP) of the disintegrating tool 50 into the borehole 26 for a given formation and a drilling assembly largely depends upon the weight on bit and the drill bit rotational speed. In one aspect of the embodiment of FIG. 1, the mud motor 55 is coupled to the disintegrating tool 50 via a drive shaft (not shown) disposed in a bearing assembly 57.

The mud motor 55 rotates the disintegrating tool 50 when the drilling fluid 31 passes through the mud motor 55 under pressure. The bearing assembly 57 supports the radial and axial forces of the disintegrating tool 50, the downthrust of the drilling motor and the reactive upward loading from the applied weight on bit. Stabilizers 58 coupled to the bearing assembly 57 and other suitable locations act as centralizers for the lowermost portion of the mud motor assembly and other such suitable locations.

A surface control unit 40 receives signals from the downhole sensors 70 and devices via a transducer 43, such as a pressure transducer, placed in the fluid line 38 as well as from sensors S1, S2, S3, hook load sensors, RPM sensors, torque sensors, and any other sensors used in the system and processes such signals according to programmed instructions provided to the surface control unit 40. The surface control unit 40 displays desired drilling parameters and other information on a display/monitor 42 for use by an operator at the rig site to control the drilling operations. The surface control unit 40 contains a computer, memory for storing data, computer programs, models, and algorithms accessible to a processor in the computer, a recorder, such as tape unit, memory unit, etc. for recording data and other peripherals. The surface control unit 40 also may include simulation models for use by the computer to processes data according to programmed instructions. The control unit responds to user commands entered through a suitable device, such as a keyboard. The control unit 40 is adapted to activate alarms 44 when certain unsafe or undesirable operating conditions occur.

The drilling assembly 90 also contains other sensors and devices or tools for providing a variety of measurements relating to the formation surrounding the borehole and for drilling the borehole 26 along a desired path. Such devices may include a device for measuring the formation resistivity near and/or in front of the drill bit, a gamma ray device for measuring the formation gamma ray intensity and devices for determining the inclination, azimuth, and position of the drill string. A formation resistivity tool 64, made according an embodiment described herein may be coupled at any suitable location, including above a lower kick-off subassembly 62, for estimating or determining the resistivity of the formation near or in front of the disintegrating tool 50 or at other suitable locations. An inclinometer 74 and a gamma ray device 76 may be suitably placed for respectively determining the inclination of the BHA and the formation gamma ray intensity. Any suitable inclinometer and gamma ray device may be utilized. In addition, an azimuth device (not shown), such as a magnetometer or a gyroscopic device, may be utilized to determine the drill string azimuth. Such devices are known in the art and therefore are not described in detail herein. In the above-described exemplary configuration, the mud motor 55 transfers power to the disintegrating tool 50 via a hollow shaft that also enables the drilling fluid to pass from the mud motor 55 to the disintegrating tool 50. In an alternative embodiment of the drill string 20, the mud motor 55 may be coupled below the resistivity measuring device 64 or at any other suitable place.

Still referring to FIG. 1, other logging-while-drilling (LWD) devices (generally denoted herein by numeral 77), such as devices for measuring formation porosity, permeability, density, rock properties, fluid properties, etc. may be placed at suitable locations in the drilling assembly 90 for providing information useful for evaluating the subsurface formations along borehole 26. Such devices may include, but are not limited to, temperature measurement tools, pressure measurement tools, borehole diameter measuring tools (e.g., a caliper), acoustic tools, nuclear tools, nuclear magnetic resonance tools and formation testing and sampling tools.

The above-noted devices transmit data to a downhole telemetry system 72, which in turn transmits the received data uphole to the surface control unit 40. The downhole telemetry system 72 also receives signals and data from the surface control unit 40 including a transmitter and transmits such received signals and data to the appropriate downhole devices. In one aspect, a mud pulse telemetry system may be used to communicate data between the downhole sensors 70 and devices and the surface equipment during drilling operations. A transducer 43 placed in the mud supply line 38 detects the mud pulses responsive to the data transmitted by the downhole telemetry 72. Transducer 43 generates electrical signals in response to the mud pressure variations and transmits such signals via a conductor 45 to the surface control unit 40. In other aspects, any other suitable telemetry system may be used for two-way data communication (e.g., downlink and uplink) between the surface and the BHA 90, including but not limited to, an acoustic telemetry system, an electro-magnetic telemetry system, an optical telemetry system, a wired pipe telemetry system which may utilize wireless couplers or repeaters in the drill string or the borehole. The wired pipe may be made up by joining drill pipe sections, wherein each pipe section includes a data communication link that runs along the pipe. The data connection between the pipe sections may be made by any suitable method, including but not limited to, hard electrical or optical connections, induction, capacitive, resonant coupling, or directional coupling methods. In case a coiled-tubing is used as the drill pipe 22, the data communication link may be run along a side of the coiled-tubing.

The drilling system described thus far relates to those drilling systems that utilize a drill pipe to conveying the drilling assembly 90 into the borehole 26, wherein the weight on bit is controlled from the surface, typically by controlling the operation of the drawworks. However, a large number of the current drilling systems, especially for drilling highly deviated and horizontal boreholes, utilize coiled-tubing for conveying the drilling assembly downhole. In such application a thruster is sometimes deployed in the drill string to provide the desired force on the drill bit. Also, when coiled-tubing is utilized, the tubing is not rotated by a rotary table but instead it is injected into the borehole by a suitable injector while the downhole motor, such as mud motor 55, rotates the disintegrating tool 50. For offshore drilling, an offshore rig or a vessel is used to support the drilling equipment, including the drill string.

Still referring to FIG. 1, a resistivity tool 64 may be provided that includes, for example, a plurality of antennas including, for example, transmitters 66*a* or 66*b* and/or receivers 68*a* or 68*b*. Resistivity can be one formation property that is of interest in making drilling decisions. Those of skill in the art will appreciate that other formation property tools can be employed with or in place of the resistivity tool 64.

Liner drilling can be one configuration or operation used for providing a disintegrating device becomes more and more attractive in the oil and gas industry as it has several advantages compared to conventional drilling. One example of such configuration is shown and described in commonly owned U.S. Pat. No. 9,004,195, entitled "Apparatus and Method for Drilling a Borehole, Setting a Liner and Cementing the Borehole During a Single Trip," which is incorporated herein by reference in its entirety. Importantly, despite a relatively low rate of penetration, the time of getting the liner to target is reduced because the liner is run in-hole while drilling the borehole simultaneously. This may be beneficial in swelling formations where a contraction of the drilled well can hinder an installation of the liner later on. Furthermore, drilling with liner in depleted and unstable reservoirs minimizes the risk that the pipe or drill string will get stuck due to hole collapse.

Although FIG. 1 is shown and described with respect to a drilling operation, those of skill in the art will appreciate that similar configurations, albeit with different components, can be used for performing different downhole operations. For example, wireline, coiled tubing, completions, and/or other configurations can be used as known in the art. Further, production configurations can be employed for extracting and/or injecting materials from/into earth formations. Thus, the present disclosure is not to be limited to drilling operations but can be employed for any appropriate or desired downhole operation(s). All these downhole operations include a downhole string in a borehole. The downhole string includes downhole tools that are exposed to a downhole fluid. The downhole fluid may cause wear on the downhole tools and components thereof due to corrosion caused by fluid in the borehole or due to erosion caused by fluid flowing in the borehole.

Figure 2:
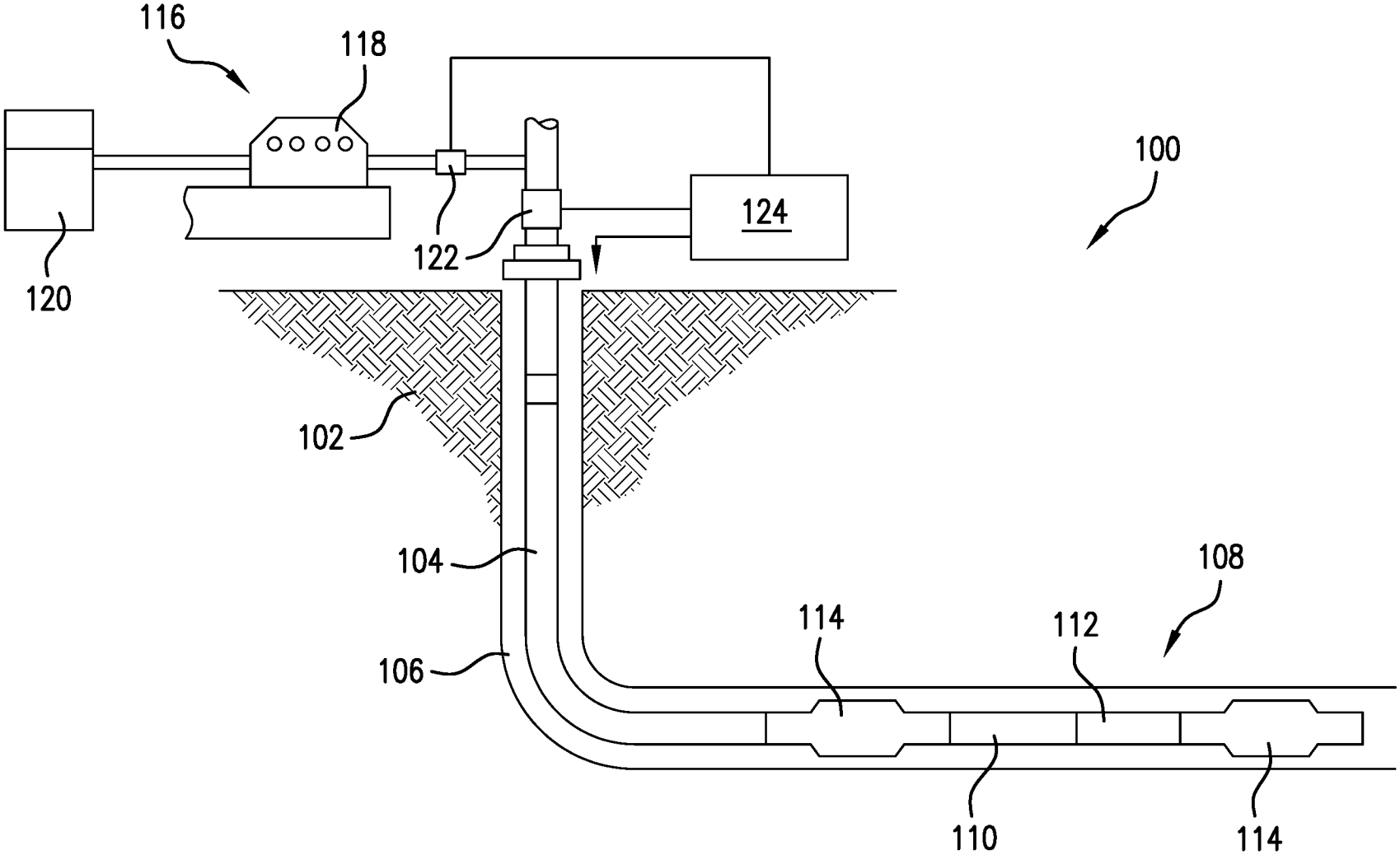
FIG. 2 depicts a system for formation stimulation and hydrocarbon production that can incorporate embodiments of the present disclosure.

Turning to FIG. 2, a schematic illustration of an embodiment of a system 100 for hydrocarbon production and/or evaluation of an earth formation 102 that can employ embodiments of the present disclosure is shown. The system 100 includes a borehole string 104 disposed within a borehole 106. The string 104, in one embodiment, includes a plurality of string segments or, in other embodiments, is a continuous conduit such as a coiled tube. As described herein, "string" refers to any structure or carrier suitable for lowering a tool or other component through a borehole or connecting a drill bit to the surface and is not limited to the structure and configuration described herein. The term "carrier" as used herein means any device, device component, combination of devices, media, and/or member that may be used to convey, house, support, or otherwise facilitate the use of another device, device component, combination of devices, media, and/or member. Example, non-limiting carriers include, but are not limited to, casing pipes, wirelines, wireline sondes, slickline sondes, drop shots, downhole subs, bottomhole assemblies, and drill strings.

In one embodiment, the system 100 is configured as a hydraulic stimulation system. As described herein, "stimulation" may include any injection of a fluid into a formation. A fluid may be any flowable substance such as a liquid or a gas, or a flowable solid such as sand. In such embodiment, the string 104 includes a downhole assembly 108 that includes one or more tools or components to facilitate stimulation of the formation 102. For example, the string 104 includes a fluid assembly 110, such as a fracture or "frac" sleeve device or an electrical submersible pumping system, and a perforation assembly 112. Examples of the perforation assembly 112 include shaped charges, torches, projectiles, and other devices for perforating a borehole wall and/or casing. The string 104 may also include additional components, such as one or more isolation or packer subs 114.

One or more of the downhole assembly 108, the fracturing assembly 110, the perforation assembly 112, and/or the packer subs 114 may include suitable electronics or processors configured to communicate with a surface processing unit and/or control the respective tool or assembly.

A surface system 116 can be provided to extract material (e.g., fluids) from the formation 102 or to inject fluids through the string 104 into the formation 102 for the purpose of fracking.

As shown, the surface system 116 includes a pumping device 118 in fluid communication with a tank 120. In some embodiments, the pumping device 118 can be used to extract fluid, such as hydrocarbons, from the formation 102, and store the extracted fluid in the tank 120. In other embodiments, the pumping device 118 can be configured to inject fluid from the tank 120 into the string 104 to introduce fluid into the formation 102, for example, to stimulate and/or fracture the formation 102.

One or more flow rate and/or pressure sensors 122, as shown, are disposed in fluid communication with the pumping device 118 and the string 104 for measurement of fluid characteristics. The sensors 122 may be positioned at any suitable location, such as proximate to (e.g., at the discharge output) or within the pumping device 118, at or near a wellhead, or at any other location along the string 104 and/or within the borehole 106.

A processing and/or control unit 124 is disposed in operable communication with the sensors 122, the pumping device 118, and/or components of the downhole assembly 108. The processing and/or control unit 124 is configured to, for example, receive, store, and/or transmit data generated from the sensors 122 and/or the pumping device 118, and includes processing components configured to analyze data from the pumping device 118 and the sensors 122, provide alerts to the pumping device 118 or other control unit and/or control operational parameters, and/or communicate with and/or control components of the downhole assembly 108. The processing and/or control unit 124 includes any number of suitable components, such as processors, memory, communication devices and power sources.

Downhole or subsurface drilling systems and/or production systems may be exposed to harsh downhole conditions. Such conditions can include high temperatures, high pressures, severe shock and vibration, and aggressive fluid flows. All of these considerations may be referred to as environmental conditions that may adversely impact components and tools that are disposed downhole. The drilling mud itself may be corrosive or cause erosion of material of the tools and components. The mud flow or fluid flow can cause erosion, corrosion, and sedimentation on the downhole equipment, including the drilling equipment itself. Erosion may occur at flow deviations, such as at areas with limited cross-section for the drilling mud, which may result in a relatively high flow velocity. Such high flow velocity may be inconsistent and may be hard to monitor, particularly with respect to the impact on the downhole tools and components. The damage caused by such erosion is difficult to detect from the outside of the tools. Accordingly, conventionally, a preventative maintenance operation (such as tripping out of the hole, disassembling the tool, and inspecting the individual components) may be required to pull the tool out of the hole and perform an inspection thereof. Such inspection, and any necessary repairs if needed, can be costly both in terms of project costs and in terms of time. Furthermore, the inspection of the downhole tools and components must be frequent enough to detect erosion and corrosion prior to failure, which can result in an excess amount of maintenance and downtime to perform the tripping, inspection, any repairs, and then redeployment of the downhole tools, components, and systems.

Embodiments of the present disclosure are directed to providing improved monitoring capabilities to downhole tools. Known types of sensors include sacrificial resistor sensors and/or ultrasonic sensors. Sacrificial resistor sensors suffer from a drawback of interaction with the drilling mud which may include elements and components that form a natural resistivity of the mud. The natural resistivity of the mud can impact the sensor readings, resulting in inaccurate monitoring. With respect to ultrasonic sensors, such sensors are typically contained within a housing within the tool and are not exposed to the drilling mud directly. However, such sensors require complex electronics and, due to the nature of measuring wall thickness, may result in inaccurate monitoring.

In accordance with embodiments of the present disclosure, a sacrificial electrical sensor element is used to monitor downhole conditions and environment. The sacrificial electrical sensor element would not be impacted by the natural resistivity of the drilling mud, and thus provides improved sensing as compared to resistance-based sensors. Further, the sacrificial electrical sensor element may be relatively simple, particularly as compared to the complex electronic systems employed and required for acoustic sensing. The sacrificial electrical sensor element disclosed herein provide for a sacrificial (wears until failure) sensing element. An erosion model may be used that takes different flow velocities, different materials, and different incident angel of the flow on the component surface into account. The erosion model enables the correlation between the sacrificial electrical sensor element and a component or tool that is being monitored and may be used to predict the remaining lifetime of the component under certain mud-flow conditions. The sacrificial electrical sensor element may be mounted on or near a tool or component to be monitored. The sacrificial electrical sensor element may be exposed to the downhole environment, including the drilling mud, and thus may be subject to the same environment and conditions as the monitored tool, thereby providing an accurate monitoring of erosion on the monitored tool. In some non-limiting embodiments, the model may be a machine learning model that is trained based on historical wear data.

Figure 3:
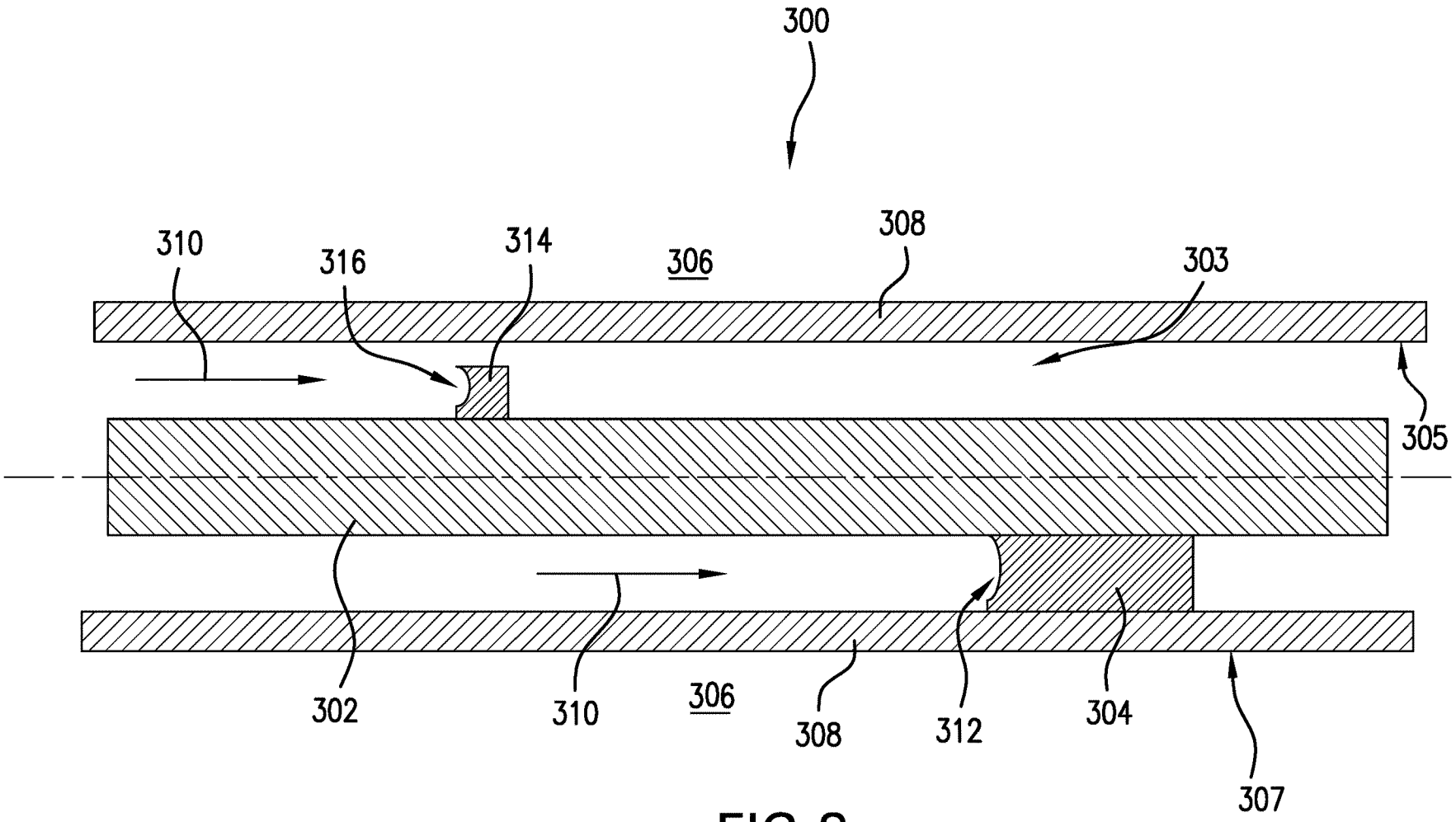
FIG. 3 is a schematic illustration of a downhole system in accordance with an embodiment of the present disclosure.

Turning now to FIG. 3, a schematic illustration of a downhole system 300 in accordance with an embodiment of the present disclosure is shown. The downhole system 300 may be part of a large downhole operation and may be part of a downhole string, a drilling assembly, and/or BHA, including an inner bore 303. As shown, the downhole system 300 includes a downhole tool 302 and at least one monitored component 304. In some embodiments, the downhole tool may be the monitored component. The downhole tool 302 may be part of a probe style measurement-while-drilling or logging-while-drilling tool where the downhole tool is a probe located within the inner bore of the downhole system 300. As shown, the downhole system 300 includes a downhole system housing 308, such as a tubular, sleeve, tool collar, or the like. In one non-limiting example, the monitored component 304 may be a blade or other cutting element of a drilling system. It will be appreciated that the monitored component 304 may be any component, tool, or device that is deployed downhole and exposed to a downhole environment, including exposure to downhole fluid such as a drilling mud. For example, in accordance with some embodiments, such monitored components can include, without limitation, mud-valves for pulse data transmissions, turbine blades to drive alternators for electrical energy generation/supply, drilling turbines to drive the drill bit, support elements that fix and position a sensor-probe or electronics-probe, electrical connectors inside a drill string, nozzles to create pressure drops, an inner surface 305 or the wall of the downhole system housing 308 and the like, may be represented by the monitored component 304. The downhole system 300 is disposed within a borehole 306 defined by borehole walls (not shown) that are formed by a drilling or disintegrating device (e.g., the downhole system including the monitored component 304 or other device). In an alternative embodiment, the downhole system may be located downhole inside a casing of a cased borehole. As such, the illustrative embodiment of FIG. 3 is merely an example of one implementation in accordance with embodiments of the present disclosure, and the specific configuration thereof is not intended to be limiting.

During a drilling operation, drilling mud 310 will be pumped through the downhole system 300, ejected into the borehole at the drilling head (e.g., drilling bit) and then will flow back upward to the surface through the annulus between the drilling system 300 and the borehole wall of the borehole 306. As the drilling mud 310 flows through the inner orifices of the drilling system (inner bore), the drilling mud 310 will interact with, contact, and flow against the inside components of the downhole system 300 and will impact or cause erosion of the monitored component 304. As a result, the monitored component 304 may be subject to damage or erosion 312. Although the monitored component 304 may be robust for operation downhole, during use wear, erosion, and corrosion are all possible and will reduce the lifetime of the monitored component 304. If such environmental impact is excessive, it can result in part or component failure. Accordingly, monitoring the state of environmental impact on the monitored component 304 can be beneficial.

In this illustrative embodiment, the downhole system 300 includes a sacrificial electrical sensor element 314. The sacrificial electrical sensor element 314 is attached to the inner probe of a downhole system 300 at a location proximate to the monitored component 304 such that the sacrificial electrical sensor element 314 will be exposed to the same mud conditions but may have different flow-velocity and different flow-deflection or impact angle. In accordance with some embodiments, the sacrificial electrical sensor element 314 may have a distance from the monitored component 304 between 1 mm and 10 cm. In other embodiments, the distance may be between 1 mm and 1 m. In still further embodiments, the distance may be between 1 mm and 10 m. In yet other embodiments, the sacrificial electrical sensor element 314 may be attached to the monitored component 304.

The sacrificial electrical sensor element 314 may subsequently suffer the same or substantially similar erosion 316 of material as the erosion 312 of material on the monitored component 304. The sacrificial electrical sensor element 314 may be configured to wear at a known rate relative to a wear rate of the erosion 312 of the monitored component 304. By calibrating and correlating the wear rate of the sacrificial electrical sensor element 314 to the monitored component 304, an indication of the wear on the monitored component 304 may be achieved without modifying or altering the monitored component 304 in any direct manner. Further, such sacrificial electrical sensor element 314 can be calibrated such that an indication of wear on the monitored component 304 is indicative of a predetermined amount of wear (a predetermined amount of material loss) prior to failure such that an operational action in response to detecting wear may comprise a notification is generated by the sacrificial electrical sensor element 314, the monitored component 304 may be pulled from the downhole environment for repair, replacement, or other maintenance. Multiple subsequent determinations of the erosion at the monitored component 304 may be used to determine an erosion rate. The erosion rate can be used to predict the remaining lifetime of the monitored component 304. In accordance with some embodiments, the lifetime prediction may take the potentially different mud flow conditions (e.g., sand content, viscosity, flow rate, temperature, etc.) of the past and, potentially, of the future, into consideration. In accordance with some embodiments, a model may be used to predict the remaining lifetime and/or the determination of wear on the sacrificial electrical sensor element 314 that leads to a failure of the monitored component 304. The wear will change with time, as the downhole tool 302 in the downhole system 300 is exposed to the fluid. The level of corrosion and/or erosion will increase with the time the downhole tool 302 is exposed to the fluid in the borehole. The corrosion/erosion will remove material from the downhole tool and the electrical sacrificial sensor element 314 so that an amount of material will be decreased with the time the electrical sacrificial sensor element 314 and the downhole tool 302 are exposed to the fluid.

Although shown with a specific arrangement of the monitored component 304 and the sacrificial electrical sensor element 314 in FIG. 3, such arrangement and positioning of such elements is not to be limited to this configuration. For example, in some embodiments, the monitored component 304 and the sacrificial electrical sensor element 314 may be on or in an outer surface 307 of the downhole system 300 within the annulus between the drilling system 300 and the borehole wall of borehole 306 (i.e., exposed to fluids or material in the borehole 306).

As illustrated in FIG. 3, the drilling mud 310 has a flow direction, and thus will impact and wear both the monitored component 304 and the sacrificial electrical sensor element 314 on an upstream side. However, the opposite (downstream) side of the monitored component 304 and the sacrificial electrical sensor element 314 will not be so worn. As such, the flow and directional wear provides for the ability to include a control portion for monitoring the wear on both the sacrificial electrical sensor element 314 and the monitored component 304. That is, each of the sacrificial electrical sensor element 314 and the monitored component 304 will experience material loss or erosion on the upstream or font side and the downstream or back side of the respective elements will stay unaffected.

Figure 4A:
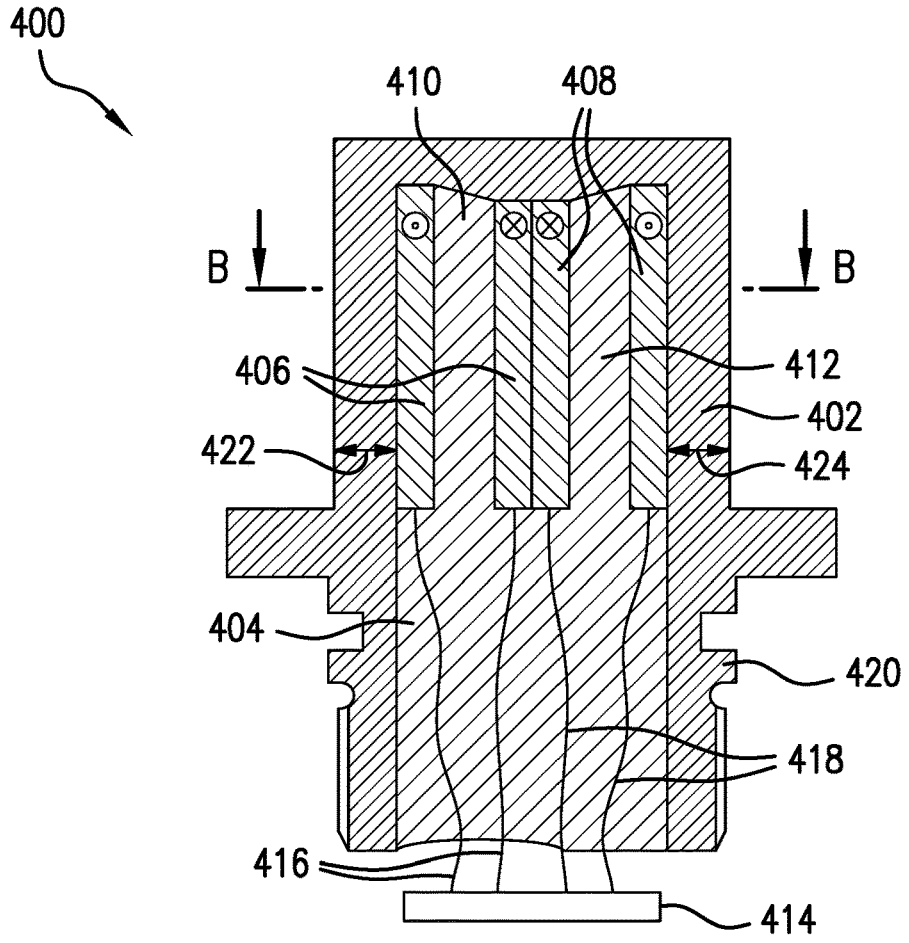
FIG. 4A is a schematic illustration of a sacrificial electrical sensor element in accordance with an embodiment of the present disclosure.
Figure 4B:
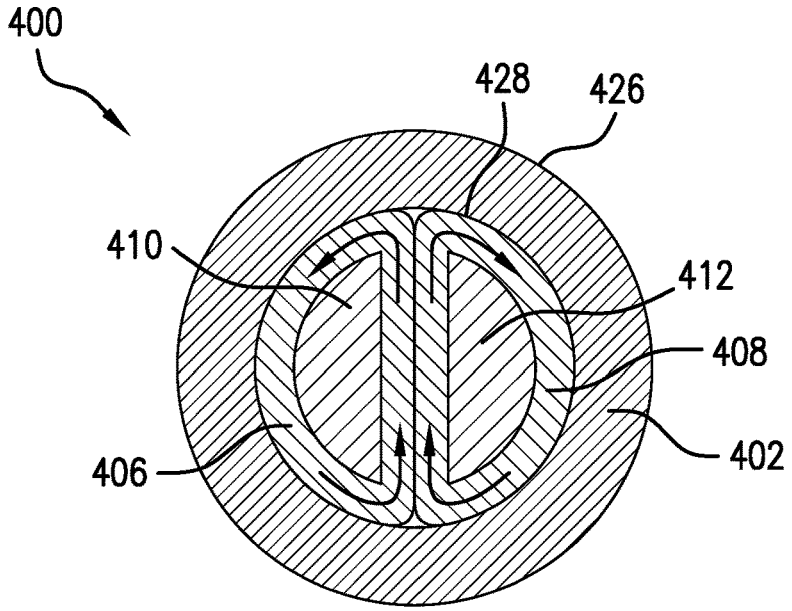
FIG. 4B is a cross-sectional illustration of the sacrificial electrical sensor element of FIG. 4A as viewed along the line B-B of FIG. 4A.

For example, turning now to FIGS. 4A-4B, schematic illustrations of a sacrificial electrical sensor element 400 in accordance with an embodiment of the present disclosure is shown. The sacrificial electrical sensor element 400 is configured to be attached to or otherwise mounted to an exterior of a downhole tool inside the downhole system such that the sacrificial electrical sensor element 400 will be exposed to downhole conditions and environment when deployed downhole. The sacrificial electrical sensor element 400 includes a housing 402, an interior body 404, a first coil 406, and a second coil 408. The housing 402 contains the interior body 404, the first coil 406, and the second coil 408. The interior body 404 includes a first coil support 410 and a second coil support 412. The first coil 406 is wound or wrapped about the first coil support 410 and the second coil 408 is wound or wrapped about the second coil support 412. The first coil 406 may be electrically connected to a controller 414 by first contact wires 416 and the second coil 408 may be electrically connected to the controller 414 by second contact wires 418.

The housing 402 may be formed of a soft magnetic material, such as and without limitation, mild steels, corrosion resistant soft magnetic materials (e.g., martensitic steels, iron-cobalt-vanadium soft magnetic alloys, etc.), and the like. The material of the housing 402 may be selected to mimic the wear on a component to be monitored. The interior body 404 may also be made of a soft magnetic material and may be the same or a different material than that selected for the housing 402. For example, the interior body 404 may be formed from, without limitation, mild steels, corrosion resistant soft magnetic materials (e.g., martensitic steels, iron-cobalt-vanadium soft magnetic alloys, etc.), and the like. The housing 402 includes a connector 420 for a connection with a tool body (e.g., the downhole tool 302 shown in FIG. 3). Magnetic and soft magnetic materials are defined as having a magnetic permeability greater than about $1.26*10^{-4}$ $N/A^{-2}$ (ferromagnetic or ferrimagnetic material).

It will be appreciated that various types of connection may be possible without departing from the scope of the present disclosure. For example, and without limitation, the sacrificial electrical sensor elements of the present disclosure may be affixed or attached by threaded connection, snap engagements, separate fasteners (e.g., screws, rivets, etc.), adhesives, bonding, welding, clamp mechanisms, and the like. In some embodiments it may be advantageous to attach the sacrificial electrical sensor element to the tool by a means that allows the sacrificial electrical sensor element to be easily removed and/or replaced, such as during a maintenance operation where the associated monitored component is maintained/repaired. In some embodiments, a seal or O-ring may be employed to prevent fluid from entering a tool or component to which the sacrificial electrical sensor element is installed.

The controller 414 may be a printed circuit board or other electronics package that is configured to monitor an electrical property of the first and second coils 406, 408. Electrical properties of a coil may include, without limitation, the inductance and the ohmic resistance of the coil. As such, the controller 414 may be configured to supply an electrical current through the first and second contact wires 416, 418. Because the interior body 404 and the housing 402 are formed from magnetic material, the amount of inductance of the coils 406, 408 is directly related or proportional to the amount of material adjacent the coils 406, 408. As a result, a change in the wall thickness of the housing 402 proximate a coil 406, 408 due to erosion will be reflected in a measurement of inductance change of the respective coil 406, 408. Alternatively, the coils of the sacrificial sensor may be arranged to form a differential transformer. In such a configuration, for example, a common coil is configured to create a magnetic flux in the support elements 410, 412 where the coils 406, 408 experience induction of electrical currents. The difference in the induction between the coils 406, 408 that is caused by a local change in wall thickness of the housing 402 due to erosion can lead to a difference in induced current that can be measured as a difference in voltage across a resistance in the controller 414.

As shown in FIGS. 4A-4B, the housing 402 has an upstream wall thickness 422 and a downstream wall thickness 424. The wall thicknesses 422, 424 are a radial thickness from an outer diameter surface 426 to an inner diameter surface 428 of the housing 402. When initially installed or unused, the upstream wall thickness 422 and the downstream wall thickness 424 will be the same. However, as the upstream surface of the sacrificial electrical sensor element 400 is exposed to downhole conditions, including a flow of drilling mud, the upstream wall thickness 422 will lessen by erosion and/or corrosion. As the wall thickness changes, the inductance of the first coil 406 will change. This change in inductance of the first coil 406 may be compared to the inductance of the second coil 408, thus providing a measure of the change in wall thickness, as the second coil 408 may be used as a control or comparison. The wear on the upstream wall thickness 422 may be used to indicate wear on a monitored component that the sacrificial electrical sensor element 400 is associated with. When the inductance of the first coil 406 reaches a predetermined limit or threshold, the controller 414 may be configured to generate a signal indicative of wear on the monitored component. The signal may be transmitted uphole using known means, such as mud pulse telemetry, wireline, etc. Upon receipt of the signal, an operator may decide to cease drilling operations to pull the tool from the borehole and perform maintenance thereon.

In accordance with some embodiments, only a portion of the housing is formed from magnetic material. In such embodiments, this portion of the housing provides a path for the magnetic flux generated by the coil. The portion of the housing formed from magnetic material forms an amount of magnetic material that is in magnetic communication with the coil. Due to corrosion or erosion, the amount of magnetic material may decrease leading to a change in electrical properties of the coil. As a result, the magnetic resistance for the magnetic flux generated by the coil will increase. A change in electrical properties of the coil (such as a change of inductance) will result in a change of a signal provided to the coil. In some embodiments, the housing or the amount of magnetic material may form a closed path for the magnetic flux generated by the coil.

Figure 5:
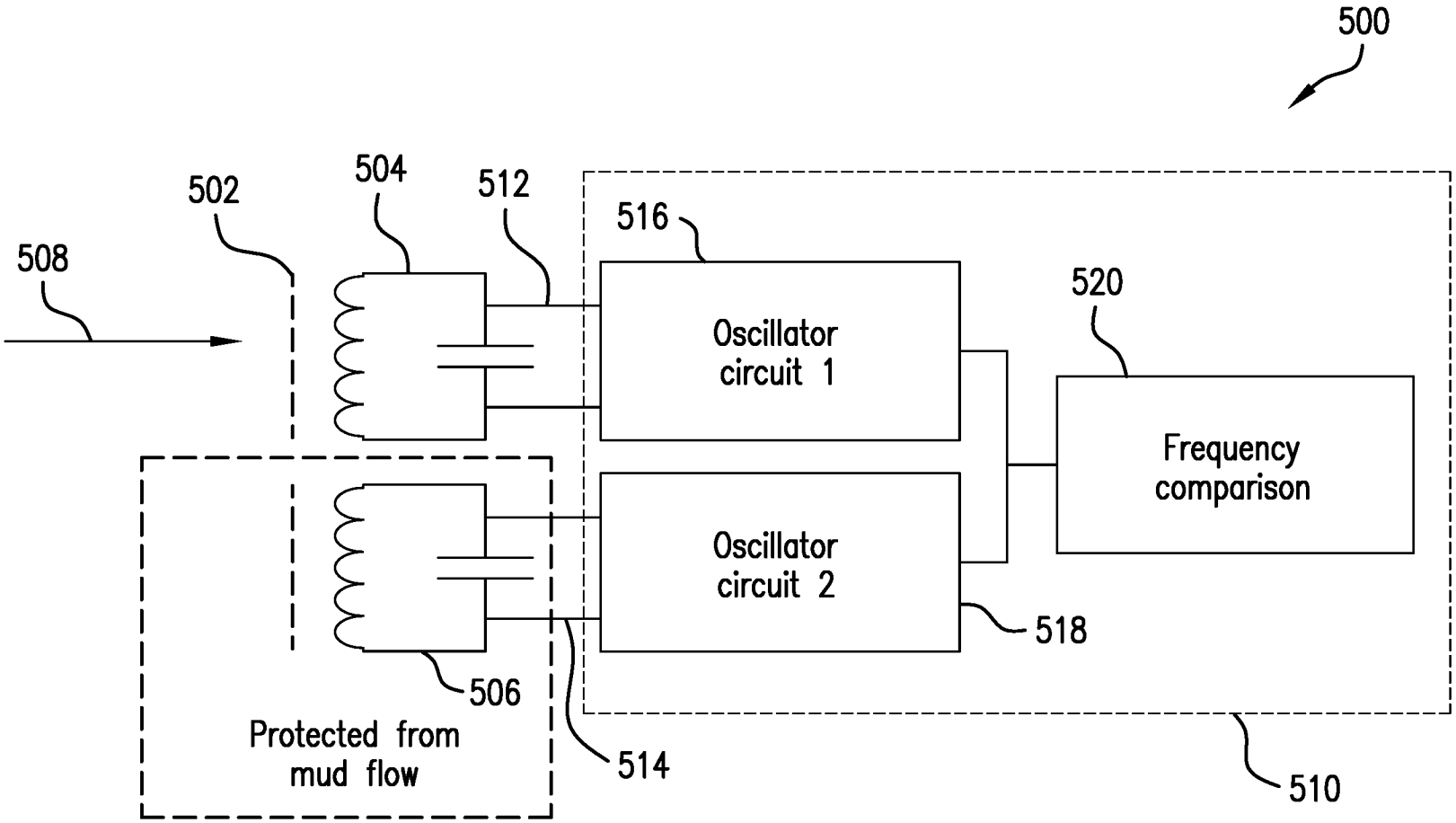
FIG. 5 is a schematic diagram of a sacrificial electrical sensor element in accordance with an embodiment of the present disclosure.

Turning now to FIG. 5, a schematic electrical diagram of a sacrificial electrical sensor element 500 in accordance with an embodiment of the present disclosure is shown. The sacrificial electrical sensor element 500 may have a physical structure and arrangement similar to that shown in FIGS. 4A-4B. The sacrificial electrical sensor element 500 includes a housing 502 with a first coil 504 and a second coil 506 arranged therein. The first coil 504 is arranged within the housing 502 such that it will be arranged proximate an upstream wall of the housing 502 and thus exposed to a mud flow 508. The second coil 506 is arranged within the housing 502 such that a proximate wall of the housing 502 is not directly exposed to the mud flow 508. The electrical sensor element is connected to a power supply (not shown). The power supply may be a battery and/or a downhole generator or other power source (e.g., a generator driven by a turbine to transfer flow energy in electrical energy). In some embodiments, power may be provided from a surface location through a wire connection in the drill string. The controller may control the power supply to the first coil 504 and the second coil 506.

The first coil 504 is electrically connected to a controller 510 by first contact wires 512 and the second coil 506 is electrically connected to the controller 510 by second contact wires 514. The controller 510 can include various electrical and/or electronic components for the purpose of generating and monitoring an electrical current through each of the first coil 504 and the second coil 506. For example, as shown, the controller 510 includes a first oscillator circuit 516 and a second oscillator circuit 518. The first oscillator circuit 516 is configured to direct an electrical current into or through the first coil 504 and the second oscillator circuit 518 is configured to direct an electrical current into or through the second coil 506 whereby the coils 504, 506 determine the frequencies of the oscillator circuits. The first oscillator circuit 516 is tuned to a specific frequency, depending on the inductance of the first coil 504. The second oscillator circuit 518 is also tuned to a specific frequency, depending on the inductance of the second coil 506. In an unworn state, the frequencies of the first oscillator circuit 516 and the second oscillator circuit 518 may be equal or may have a defined (e.g., known) frequency difference. When wear of the housing 502 occurs, the frequency of the first oscillator circuit 516 will change due to the changing inductance of the first coil 504 that results from a changed amount of magnetic material in the flow path of the magnetic flux of the first coil 504. The frequency of the second oscillator circuit 518 will not change due to erosion because the magnetic material of the coil 506 is protected from erosion. As such, the magnetic material in the flow path of the magnetic flux of the second coil 506 will not change.

A frequency comparison unit 520 is arranged within or as part of the controller 510 and is configured to compare a frequency from the first oscillator circuit 516 and the second oscillator circuit 518. This comparison enables a determination of the change in wall thickness of the housing 502. For example, when the two frequencies are the same, the two coils 504, 506 have the same inductance, due to the same wall thickness proximate the two coils 504, 506. However, as the wall thickness of the housing 502 erodes due to exposure to the mud flow 508, the frequency of a signal from the first coil 504 will change, thus resulting in a non-zero frequency comparison at the frequency comparison unit 520. This non-zero value can be used to determine a wear-state of an associated monitored component. The frequency comparison unit 520 is configured to detect the change in frequency of the first oscillator circuit 516 or a change in frequency difference between the first oscillator circuit 516 and the second oscillator circuit 518. The frequency change of the first oscillator circuit 516 or the change of the difference between the frequency of the first oscillator circuit 516 and the second oscillator circuit 518 is a measure for the amount of erosion that took place on the magnetic material of the first coil 504.

Figure 6:
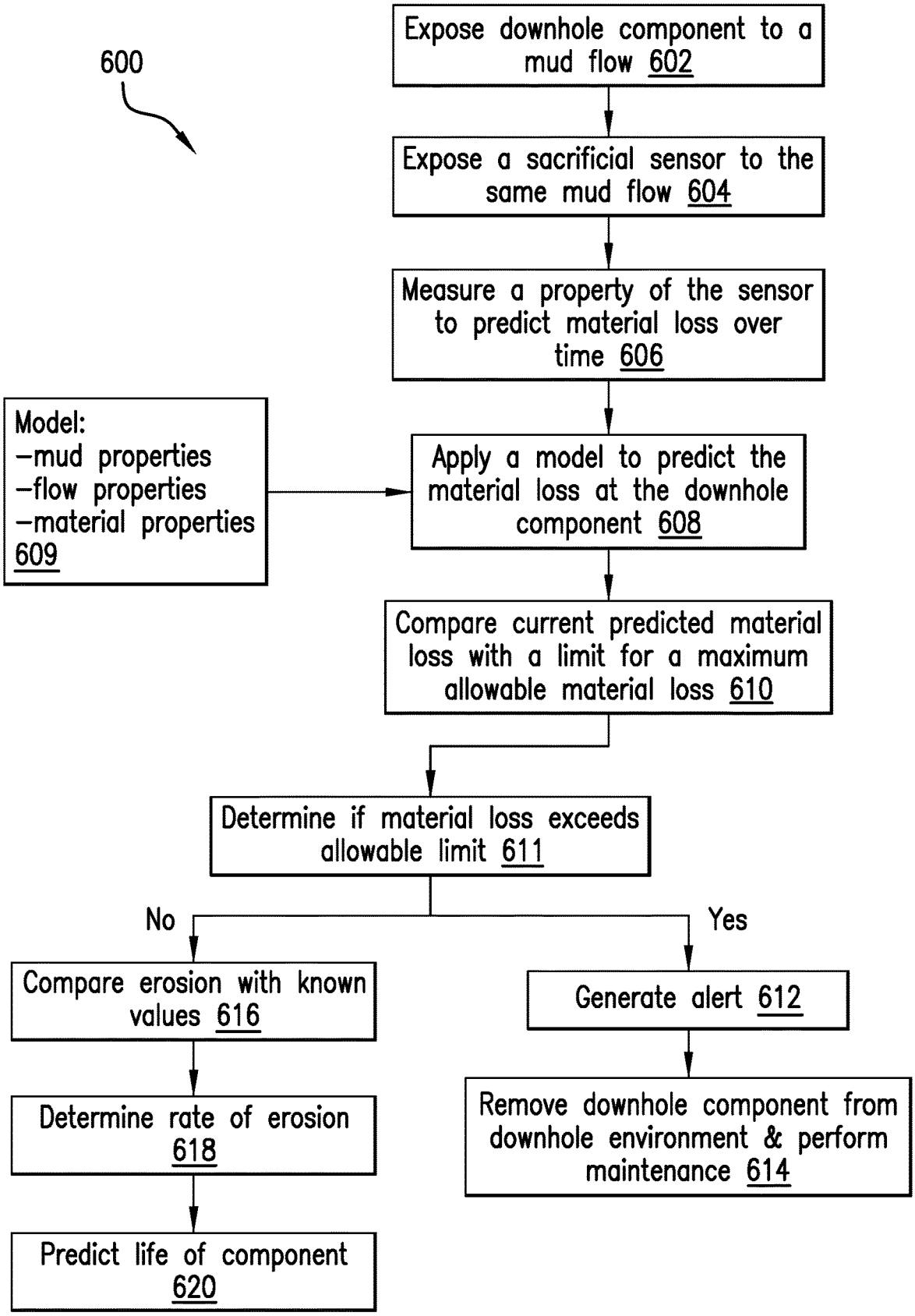
FIG. 6 is a flow process for monitoring wear of downhole components and tools in accordance with an embodiment of the present disclosure.

FIG. 6 is a flow diagram of a monitoring process that employs a sacrificial electrical sensor element in accordance with an embodiment of the present disclosure. At step 602, a downhole component is exposed to a mud flow, and at step 604 the sacrificial electrical sensor element is exposed to the same mud flow. The exposure to the same mud flow may be achieved by installing the sacrificial electrical sensor element to the downhole component, or at a location near/proximate the downhole component. As used herein, the terms "near" and "proximate" refer to locations of the sacrificial electrical sensor element relative to the monitored downhole component. As such, these terms may refer to relative position along a downhole string, with the terms referring to a placement of the sacrificial electrical sensor element such that it can be exposed to and experience the same or substantially similar downhole environmental conditions as the monitored downhole component. In some embodiments, these terms may refer to the sacrificial electrical sensor element being attached to, mounted to, or otherwise connected to the same section of the downhole system as the monitored component (e.g., on same section of string, same BHA, same sub of a downhole system, etc.). When the same section/sub may not be possible, the sacrificial electrical sensor element may be arranged on an adjacent section/sub, such that the sacrificial electrical sensor element is exposed to as close to the same conditions as the monitored downhole component. The intent is to have the sacrificial electrical sensor element arranged as close to the monitored downhole component as possible or as practicable without impacting operation or functionality of the monitored downhole component. It will be appreciated at in some embodiments, depending on the nature of the monitored downhole component, the sacrificial electrical sensor element may be directly attached to or mounted to the monitored downhole component as such attachment may not impact the operation and functionality of the component.

The downhole component and the sacrificial electrical sensor element are deployed downhole, and the downhole component is used to perform a drilling operation, a logging operation, a measurement operation, or the like, as will be appreciated by those of skill in the art. During such operation, the downhole component and the sacrificial electrical sensor element will be exposed to flowing drilling mud, which may erode or otherwise wear upon the downhole component and the sacrificial electrical sensor element.

At step 606 a property of the sacrificial electrical sensor element is measured to predict material loss over time. For example, the sacrificial electrical sensor element may be configured to measure an inductance at the sensor such that changes in wall thickness impact the inductance which can be measured, as described above.

At step 608, a model is used to predict a material loss at the downhole component based on the measured property of the sacrificial electrical sensor element. The model used at step 608 may use various inputs 609 and predetermined information, such as, and without limitation, mud properties for the particular drilling or downhole operation, flow properties of the mud, and material properties of both the sacrificial electrical sensor element and the downhole component.

At step 610, the predicted material loss determined at step 608 is compared against a limit of allowable material loss on the downhole component. In some embodiments, the limit of allowable material loss may represent a loss of material that does not directly impact the operation and functionality of the downhole component but may be indicative of a soon or upcoming failure or damage to the downhole component. That is, in some embodiments, the selected limit of allowable material loss may merely indicate an amount of loss that requires attention from an operator, such as to perform maintenance upon the downhole component. This comparison may be performed continuously, at a predetermined interval, and/or upon demand from a user or other tool (at the surface or downhole). In some embodiments, the comparison is performed using a controller or other downhole electronics that are part of the sacrificial electrical sensor element. In other embodiments, the sacrificial electrical sensor element may be operably connected to an electronics processor or controller of another downhole tool and may not be a dedicated or independent electrically circuit.

At step 611, the material loss is compared against known or preset values/thresholds, and it is determined if such thresholds or limits are exceeded.

At step 612, if it is determined that the material loss exceeds the allowable material loss or predetermined threshold at step 611, an alert is generated. The alert may be transmitted uphole to the surface by known telemetry means, such as mud pulse telemetry, wireline, and the like.

At step 614, the downhole component may be removed from the downhole environment. An operator may perform an inspection or perform other maintenance and/or replacement of the downhole component.

At step 616, if it is determined at step 611 that the material loss does not exceed the limits or thresholds, then the component may not require maintenance and/or replacement. As such, at step 616, the detected material loss, wear, or erosion may be compared with known values. The known values maybe values obtained for erosion and wear of the same or substantially similar components in the same or substantially similar conditions (e.g., other wells, laboratory testing, mathematical simulations, etc.).

At step 618, from the comparison of the measured material loss or erosion with known values, a rate of erosion may be calculated.

At step 620, the calculated rate of erosion or material loss may be used to predict a life of the component. Based on the calculated life of the component an estimate of when maintenance and/or replacement may be required can be set. Such calculated life may be used to trigger implementation of the flow process 600 again.

In an alternative embodiment of flow process 600, after step 611, the process flow 600 may return to process step 606 when it is determined, at step 611, that the preset values/thresholds are not exceeded. It will be appreciated that other modifications or different flow processes may be implemented without departing from the scope of the present disclosure.

Figure 7:
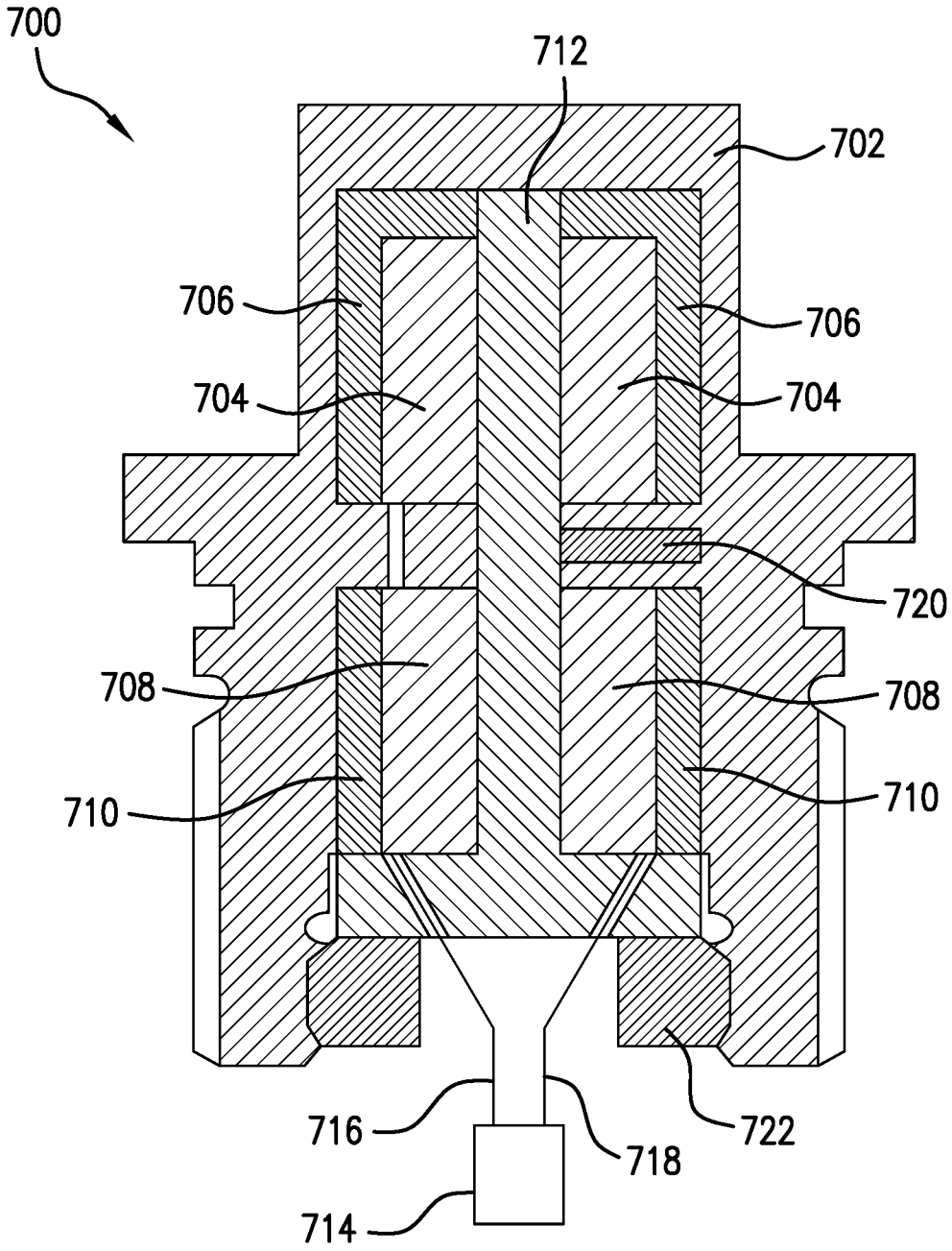
FIG. 7 is a schematic illustration of a sacrificial electrical sensor element in accordance with an embodiment of the present disclosure.

Turning now to FIG. 7, a schematic illustration of a sacrificial electrical sensor element 700 in accordance with an embodiment of the present disclosure. The sacrificial electrical sensor element 700 is configured to be attached to or otherwise mounted to an exterior of a downhole tool such that the sacrificial electrical sensor element 700 will be exposed to downhole conditions and environment when deployed downhole. The sacrificial electrical sensor element 700 includes a housing 702, a first transformer winding 704 arranged within a first support shell 706, and a second transformer winding 708 arranged within a second support shell 710.

The housing 710 contains and substantially protects the first transformer winding 704 and first support shell 706 and the second transformer winding 708 and second support shell 710. The housing 702, in this embodiment, includes an interior body 712 that may be configured as a winding support about which the first transformer winding 704 and the second transformer winding 708 may be wrapped. The first transformer winding 704 may be electrically connected to a controller 714 by first contact wires 716 and the second coil 708 may be electrically connected to the controller 714 by second contact wires 718. The housing 702 may also contain locking screw 720 and locknut 722, which may be used to assemble the components of the sacrificial electrical sensor element 700. The housing 702 may be configured to engage with a portion of a downhole tool or component such that the housing 702 is at least partially exposed to a downhole environment and may be subject to wear, erosion, and/or corrosion due to exposure to a mud flow.

The housing 702 may be formed from a soft magnetic material, such as mild steels, corrosion resistant soft magnetic materials (e.g., martensitic steels, iron-cobalt-vanadium soft magnetic alloys, etc.), and the like. The support shells 706, 710 are arranged about the first and second transformer windings 704, 708 and provide structure support and rigidity to the transformer windings 704, 708. The support shells 706, 710 may be formed from non-magnetic, high-strength materials, including, but not limited to high-strength, corrosion-resistant nickel chromium materials. In some embodiments, the support shells 706, 710 may be provided to support and protect the housing 702. This may be due to the housing 702 being formed from material not having sufficient strength to resist the high geostatic pressures downhole. In some embodiments, one or both support shells 706, 710 may be omitted. For example, in some embodiments, the second support shell 710 may be eliminated because the illustrative portion protected by the second support shell 710 may be manufactured with a greater wall thickness, thus eliminating the need for the second support shell 710. It will be noted that there may be advantages to including both support shells 706, 710. For example, due to the magnetic nature of the sensors, maintaining symmetry may be beneficial between the circuitry of both coils to eliminate variance, and to provide as close to a one-to-one comparison as possible.

In some embodiments, the housing 702 and/or the sacrificial electrical sensor element 700 may be considered to have a first portion that is exposed to a fluid and a second portion that is protected from fluid flow. Although the housing may be formed from a single magnetic material, the different portions may have different wear rates or the like due to the exposure to the fluid.

In operation, the first and second transformer windings 704, 708 may be supplied with an electrical AC current from the controller 714. The magnetic flux of the two transformer windings 704, 708 may be measured to determine a wear, erosion, corrosion, or other environmental impact to the sacrificial electrical sensor element 700. The magnetic flux of the transformer windings 704, 708 may be dependent upon a material wall thickness of the housing 702, similar to that described above. In this sacrificial electrical sensor element 700, the control winding (second transformer winding 708) is not arranged on a downstream side of the sacrificial electrical sensor element 700, but rather is arranged inward (e.g., radially inward when installed to a component or tool) and is protected from a mud flow.

Similar to the prior configuration, a magnetic flux of the first transformer winding 704 may be compared with a magnetic flux of the second transformer winding 708, and such comparison can be used to estimate a change in the material wall thickness of the housing 702 that is exposed to the downhole environment. In some embodiments, the voltage and phase of an electrical signal from each of the first and second transformer windings 704, 708 may be monitored. As the material of the housing 702 is worn away by exposure to mud flow or other downhole conditions, the magnetic flux of the first transformer winding 704 will change, and such change can be used to estimate an amount of wear on the housing 702. This wear on the housing 702 can then be used to estimate a wear on an associated downhole component, tool, or element of interest. As a result, monitoring of wear on a downhole tool or component may be provided through use of the sacrificial electrical sensor element 700. It is noted that the transformer configuration described herein may be similar to that of a differential transformer, such as a linear variable differential transformer, as will be appreciated by those of skill in the art.

In accordance with embodiments of the present disclosure, as discussed above, the wear upon the sacrificial electrical sensor elements may be calibrated or correlated to wear on a specific downhole tool, component, or other structure or device of interest. The correlation, in some embodiments, may be a matrix calculation with pre-known wear conditions. That is, the material of the sacrificial electrical sensor element and the material of the tool of interest or monitored component may be selected to enable a correlation between the wear on the sacrificial electrical sensor element and the wear on the tool or component. Various factors may be considered for such correlation, including, but not limited to, material choices, drilling mud properties, drilling mud flow properties, formation materials to be drilled and may impact the wear on the sensor and/or the tool/component, etc. A controller may be configured to electrically connect to the sacrificial electrical sensor element such that an inductance or magnetic flux may be monitored.

It will be appreciated that the simplest configuration of the sacrificial electrical sensor elements of the present disclosure includes a single winding or coil. However, as shown and described above, a dual-winding or dual-coil configuration may enable more accuracy due to a control measurement and the described comparison of the sensing element exposed to the mud flow as compared to a sensing element that is protected from such flow. As such, in the single winding/coil configuration, an absolute value of inductance or magnetic flux may be monitored and correlated with a wear on a monitored component. However, the addition of a second winding/coil can provide a control value that is used to ensure that variation mainly caused by temperature variation, pressure influences, and/or noise can be eliminated from the electrical signals. The protected coil/winding may enable compensation and accounting of temperature exposure and temperature impacts on the inductance/magnetic flux and may account for aging of materials. It will be appreciated that additional windings/coils may be employed for various purposes, including control, comparison, etc., as will be appreciated by those of skill in the art. Further, it will be appreciated that multiple sacrificial electrical sensor elements may be employed to monitor wear on a single monitored component, or multiple sacrificial electrical sensor elements may be employed in a downhole system for monitoring one or more tools/components of interest.

The measurements disclosed herein, associated with the described sacrificial electrical sensor elements, may be a measurement of a property of the electrical signal of the sacrificial electrical sensor elements, such as frequency, amplitude, or phase. Measurement of frequency is a relatively simple, yet accurate and precise indicator of changes of materials proximate the windings/coils. This allows for an accurate estimation of the wear on a monitored component, thus optimizing the maintenance schedule for the monitored component while minimizing downtime of a drilling and/or other downhole production or operation. In some embodiments, in combination with or alternative to the frequency, the phase or current amplitude or voltage amplitude of an alternating signal through the coil may be measured. Amplitude and phase are dependent on the inductance. The inductance depends on the magnetic properties (such as magnetic permeability and/or magnetic resistance) of the magnetic material surrounding the coil and providing a path for the magnetic flux generated by the coil, when an alternating current or voltage is applied to the coil. When the magnetic resistance or the magnetic permeability changes due to erosion of magnetic material in magnetic communication with the coil, the amplitude and/or phase of an alternating current or voltage will change. Erosion leads to a change in the amount of magnetic material in communication with the coil. Due to the frequency change or the change of the phase and/or amplitude of the alternating current or voltage through or at the coil, the change in the amount of magnetic material in communication with the coil can be determined. The change in amount of magnetic material is an indicator for the wear level of the downhole tool in the downhole string.

Advantageously, embodiments provided herein are directed to passive monitoring systems that enable monitoring of wear of downhole components, where such monitoring is performed in situ. The monitoring systems are arranged to enable erosion of sacrificial electrical sensor elements due to environmental conditions, such as mud flow. Through erosion of the sacrificial electrical sensor elements and monitoring an inductance or magnetic flux at a controller that is electrically connected to the sacrificial electrical sensor elements, an amount of wear can be measured or estimated. The wear on the sacrificial electrical sensor elements can be correlated to a specific monitored tool or component, and thus an estimation of the wear on the monitored tool or component may be provided. As the erosion of the sacrificial electrical sensor elements increases, a change in an electrical signal of the sacrificial electrical sensor elements occurs, which may be monitored and used to estimate erosion on the associated monitored component/tool. Through simulations, testing, and observation, it can be determined when a specific electrical measurement is observed (e.g., inductance, magnetic flux) that a downhole component has been subject to too much erosion or other wear.

Embodiment 1: A downhole monitoring system comprising: a downhole string disposed in a borehole, the downhole string comprising a downhole tool, wherein the borehole has fluid therein; a sacrificial electrical sensor element in or on the downhole string, wherein the sacrificial electrical sensor element comprises: magnetic material at least partially exposed to the fluid; and at least one coil arranged in magnetic communication with the magnetic material; and a controller configured to: provide an electrical current into the at least one coil, measure an electrical property of the at least one coil, wherein the electrical property of the at least one coil is based on the magnetic material in magnetic communication with the at least one coil; and determine a wear state of the downhole tool based on the measured electrical property.

Embodiment 2: The downhole monitoring system of any preceding embodiment, wherein the controller is configured to compare the measured electrical property against a predetermined value of a wear threshold of the downhole tool, and generate a notification regarding the wear state of the downhole tool when the wear threshold is met.

Embodiment 3: The downhole monitoring system of any preceding embodiment, wherein the electrical property of the at least one coil depends on an amount of the magnetic material in communication with the at least one coil, and the amount of the magnetic material in communication with the at least one coil is changes due to wear caused by the fluid.

Embodiment 2: The downhole monitoring system of any preceding embodiment, wherein the sacrificial electrical sensor element has two coils, wherein a first coil is arranged in magnetic communication with a first magnetic material exposed to the fluid and a second coil is arranged in magnetic communication with a second magnetic material protected from the fluid.

Embodiment 4: The downhole monitoring system of any preceding embodiment, wherein the controller is configured to compare an electrical property of the first coil with an electrical property of the second coil.

Embodiment 5: The downhole monitoring system of any preceding embodiment, wherein the first magnetic material is arranged on an upstream side of the sacrificial electrical sensor element relative to a flow of the fluid in the borehole and the second magnetic material is arranged on a downstream side of the sacrificial electrical sensor element relative to the flow of the fluid in the borehole.

Embodiment 6: The downhole monitoring system of any preceding embodiment, wherein the second magnetic material is arranged within the downhole tool.

Embodiment 7: The downhole monitoring system of any preceding embodiment, wherein the controller includes a first oscillator circuit electrically connected to the first coil, a second oscillator circuit electrically connected to the second coil, and a frequency comparison unit configured to compare a frequency measurement from the first oscillator circuit and the second oscillator circuit.

Embodiment 8: The downhole monitoring system of any preceding embodiment, wherein the magnetic material forms a housing and the at least one coil is arranged inside the housing.

Embodiment 9: The downhole monitoring system of any preceding embodiment, wherein the sacrificial electrical sensor element comprises a non-magnetic support shell configured to provide structural support to the at least one coil.

Embodiment 10: The downhole monitoring system of any preceding embodiment, wherein the magnetic material forms a housing, the housing comprising an interior body having a coil support, wherein the at least one coil is wrapped about the coil support.

Embodiment 11: The downhole monitoring system of any preceding embodiment, wherein the magnetic material has a magnetic permeability greater than 1.26*10−4 N/A2.

Embodiment 12: The downhole monitoring system of any preceding embodiment, wherein the electrical property is at least one of an inductance of the at least one coil, a magnetic flux of the at least one coil, or a voltage and a phase of an electrical signal of the at least one coil.

Embodiment 13: The downhole monitoring system of any preceding embodiment, wherein the controller is configured to transmit the notification to a surface unit.

Embodiment 14: A sacrificial electrical sensor system for monitoring downhole wear, the sacrificial electrical sensor system comprising: magnetic material configured to be at least partially exposed to a fluid, the magnetic material configured to attach to a downhole string, the downhole string comprising a downhole tool; at least one coil arranged in magnetic communication with the magnetic material; and a controller electrically connected to the at least one coil, the controller configured to: provide an electrical current into the at least one coil, measure an electrical property of the at least one coil, wherein the electrical property of the at least one coil is based on the magnetic material in magnetic communication with the at least one coil; and determine a wear state of the downhole tool based on the measured electrical property.

Embodiment 15: The sacrificial electrical sensor system of any preceding embodiment, wherein the controller is configured to compare the measured electrical property against a predetermined value of a wear threshold of the downhole tool, and generate a notification regarding the wear state of the downhole tool when the wear threshold is met.

Embodiment 16: The sacrificial electrical sensor system of any preceding embodiment, wherein the sacrificial electrical sensor system has two coils, wherein a first coil is arranged in magnetic communication with a first magnetic material exposed to the fluid and a second coil is arranged in magnetic communication with a second magnetic material protected from the fluid.

Embodiment 17: The sacrificial electrical sensor system of any preceding embodiment, wherein the controller includes a first oscillator circuit electrically connected to the first coil, a second oscillator circuit electrically connected to the second coil, and a frequency comparison unit configured to compare a frequency measurement from the first oscillator circuit and the second oscillator circuit.

Embodiment 18: The sacrificial electrical sensor system of any preceding embodiment, wherein the magnetic material forms a housing and the at least one coil is arranged inside the housing.

Embodiment 19: The sacrificial electrical sensor system of any preceding embodiment, wherein the magnetic material has a magnetic permeability great than 1.26*10−4 N/A2.

Embodiment 20: A method for monitoring components disposed in a downhole environment, the method comprising: disposing a downhole string in a borehole, the downhole string comprising a downhole tool, wherein the borehole has fluid therein, the downhole string comprising a sacrificial electrical sensor element in or on the downhole string, wherein the sacrificial electrical sensor element comprises magnetic material at least partially exposed to the fluid and at least one coil arranged in magnetic communication with the magnetic material; supplying an electrical current into the at least one coil; measuring an electrical property of the at least one coil, wherein the electrical property of the at least one coil is based on the magnetic material in magnetic communication with the at least one coil; determining a wear state of the downhole tool based on the measured electrical property; and performing an operational action based on the wear state.

Embodiment 21: The method of any preceding embodiment, wherein the electrical property of the at least one coil depends on an amount of the magnetic material in communication with the at least one coil, the amount of the magnetic material in communication with the at least one coil is changing due to wear caused by the fluid, and the operational action includes replacing the downhole tool in the downhole string.

Embodiment 22: The method of any preceding embodiment, wherein the sacrificial electrical sensor element has two coils, wherein a first coil is arranged in magnetic communication with a first magnetic material exposed to the fluid and a second coil is arranged in magnetic communication with a second magnetic material protected from the fluid, the method comprising: comparing an electrical property of the first coil with an electrical property of the second coil.

Embodiment 23: The method of any preceding embodiment, wherein the sacrificial electrical sensor element has two coils, wherein a first coil is arranged in magnetic communication with a first magnetic material exposed to the fluid and a second coil is arranged in magnetic communication with a second magnetic material protected from the fluid, and a first oscillator circuit is electrically connected to the first coil and a second oscillator circuit is electrically connected to the second coil, the method comprising: comparing a frequency measurement from the first oscillator circuit and the second oscillator circuit.

In support of the teachings herein, various analysis components may be used including a digital and/or an analog system. For example, controllers, computer processing systems, and/or geo-steering systems as provided herein and/or used with embodiments described herein may include digital and/or analog systems. The systems may have components such as processors, storage media, memory, inputs, outputs, communications links (e.g., wired, wireless, optical, or other), user interfaces, software programs, signal processors (e.g., digital or analog) and other such components (e.g., such as resistors, capacitors, inductors, and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (e.g., ROMs, RAMs), optical (e.g., CD-ROMs), or magnetic (e.g., disks, hard drives), or any other type that when executed causes a computer to implement the methods and/or processes described herein. These instructions may provide for equipment operation, control, data collection, analysis and other functions deemed relevant by a system designer, owner, user, or other such personnel, in addition to the functions described in this disclosure. Processed data, such as a result of an implemented method, may be transmitted as a signal via a processor output interface to a signal receiving device.

The signal receiving device may be a display monitor or printer for presenting the result to a user. Alternatively, or in addition, the signal receiving device may be memory or a storage medium. It will be appreciated that storing the result in memory or the storage medium may transform the memory or storage medium into a new state (i.e., containing the result) from a prior state (i.e., not containing the result). Further, in some embodiments, an alert signal may be transmitted from the processor to a user interface if the result exceeds a threshold value.

Furthermore, various other components may be included and called upon for providing for aspects of the teachings herein. For example, a sensor, transmitter, receiver, transceiver, antenna, controller, optical unit, electrical unit, and/or electromechanical unit may be included in support of the various aspects discussed herein or in support of other functions beyond this disclosure.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about", "substantially" and "generally" are intended to include the degree of error associated with measurement of the particular quantity based upon the equipment available at the time of filing the application.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the present disclosure.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While embodiments described herein have been described with reference to various embodiments, it will be understood that various changes may be made, and equivalents may be substituted for elements thereof without departing from the scope of the present disclosure. In addition, many modifications will be appreciated to adapt a particular instrument, situation, or material to the teachings of the present disclosure without departing from the scope thereof. Therefore, it is intended that the disclosure is not limited to the particular embodiments disclosed as the best mode contemplated for carrying the described features, but that the present disclosure will include all embodiments falling within the scope of the appended claims.

Accordingly, embodiments of the present disclosure are not to be seen as limited by the foregoing description but are only limited by the scope of the appended claims.

What is claimed is:

1. A downhole monitoring system comprising:

a downhole string disposed in a borehole, the downhole string comprising a downhole tool, wherein the borehole has fluid therein;

a sacrificial electrical sensor element in or on the downhole string, wherein the sacrificial electrical sensor element comprises:

magnetic material at least partially exposed to the fluid, the magnetic material selected to be eroded by the fluid; and at least one coil arranged in magnetic communication with the magnetic material; and a controller configured to:

provide an electrical current into the at least one coil, measure an indicator of an inductance of the at least one coil, wherein the indicator of the inductance of the at least one coil is configured to change due to an erosion of the magnetic material in magnetic communication with the at least one coil by the fluid; and determine a wear state of the downhole tool based on the measured indicator of the inductance.

2. The downhole monitoring system of claim 1, wherein the controller is configured to:

compare the measured indicator of the inductance against a predetermined value of a wear threshold of the downhole tool, and generate a notification regarding the wear state of the downhole tool when the wear threshold is met.

3. The downhole monitoring system of claim 1, wherein the sacrificial electrical sensor element has two coils, wherein a first coil is arranged in magnetic communication with a first magnetic material exposed to the fluid and a second coil is arranged in magnetic communication with a second magnetic material protected from the fluid.

4. The downhole monitoring system of claim 3, wherein the controller is configured to compare a measured indicator of an inductance of the first coil with a measured indicator of an inductance of the second coil.

5. The downhole monitoring system of claim 3, wherein the first magnetic material is arranged on an upstream side of the sacrificial electrical sensor element relative to a flow of the fluid in the borehole and the second magnetic material is arranged on a downstream side of the sacrificial electrical sensor element relative to the flow of the fluid in the borehole.

6. The downhole monitoring system of claim 3, wherein the second magnetic material is arranged within the downhole tool.

7. The downhole monitoring system of claim 3, wherein the controller includes a first oscillator circuit electrically connected to the first coil, a second oscillator circuit electrically connected to the second coil, and a frequency comparison unit configured to compare a frequency measurement from the first oscillator circuit and the second oscillator circuit.

8. The downhole monitoring system of claim 1, wherein the magnetic material forms a housing and the at least one coil is arranged inside the housing.

9. The downhole monitoring system of claim 8, wherein the sacrificial electrical sensor element comprises a non-magnetic support shell configured to provide structural support to the at least one coil.

10. The downhole monitoring system of claim 1, wherein the indicator of the inductance is at least one of a magnetic flux of the at least one coil or a voltage and a phase of an electrical signal of the at least one coil.

11. A method for monitoring components disposed in a downhole environment, the method comprising:

disposing a downhole string in a borehole, the downhole string comprising a downhole tool, wherein the borehole has fluid therein, the downhole string comprising a sacrificial electrical sensor element in or on the downhole string, wherein the sacrificial electrical sensor element comprises magnetic material at least partially exposed to the fluid and at least one coil arranged in magnetic communication with the magnetic material, the magnetic material selected to be eroded by the fluid;

supplying an electrical current into the at least one coil;

measuring an indicator of an inductance of the at least one coil, wherein the indicator of the inductance of the at least one coil is configured to change due to an erosion of the magnetic material in magnetic communication with the at least one coil by the fluid;

determining a wear state of the downhole tool based on the measured indicator of the inductance; and performing an operational action based on the wear state.

12. The method of claim 11, wherein:

the operational action includes replacing the downhole tool in the downhole string.

13. A method for monitoring components disposed in a downhole environment, the method comprising:

disposing a downhole string in a borehole, the downhole string comprising a downhole tool, wherein the borehole has fluid therein, the downhole string comprising a sacrificial electrical sensor element in or on the downhole string, wherein the sacrificial electrical sensor element comprises magnetic material at least partially exposed to the fluid and at least one coil arranged in magnetic communication with the magnetic material;

supplying an electrical current into the at least one coil;

measuring an electrical property of the at least one coil, wherein the electrical property of the at least one coil is based on the magnetic material in magnetic communication with the at least one coil;

determining a wear state of the downhole tool based on the measured electrical property; and performing an operational action based on the wear state, wherein the sacrificial electrical sensor element has two coils, wherein a first coil is arranged in magnetic communication with a first magnetic material exposed to the fluid and a second coil is arranged in magnetic communication with a second magnetic material protected from the fluid, the method comprising:

comparing an electrical property of the first coil with an electrical property of the second coil.

14. A method for monitoring components disposed in a downhole environment, the method comprising:

disposing a downhole string in a borehole, the downhole string comprising a downhole tool, wherein the borehole has fluid therein, the downhole string comprising a sacrificial electrical sensor element in or on the downhole string, wherein the sacrificial electrical sensor element comprises magnetic material at least partially exposed to the fluid and at least one coil arranged in magnetic communication with the magnetic material;

supplying an electrical current into the at least one coil;

measuring an electrical property of the at least one coil, wherein the electrical property of the at least one coil is based on the magnetic material in magnetic communication with the at least one coil;

determining a wear state of the downhole tool based on the measured electrical property; and performing an operational action based on the wear state, wherein the sacrificial electrical sensor element has two coils, wherein a first coil is arranged in magnetic communication with a first magnetic material exposed to the fluid and a second coil is arranged in magnetic communication with a second magnetic material protected from the fluid, and a first oscillator circuit is electrically connected to the first coil and a second oscillator circuit is electrically connected to the second coil, the method comprising:

comparing a frequency measurement from the first oscillator circuit and the second oscillator circuit.

15. A downhole monitoring system comprising:

a downhole string disposed in a borehole, the downhole string comprising a downhole tool, wherein the borehole has fluid therein;

a sacrificial electrical sensor element in or on the downhole string, wherein the sacrificial electrical sensor element comprises:

a first coil arranged in magnetic communication with a first magnetic material exposed to the fluid; and a second coil arranged in magnetic communication with a second magnetic material protected from the fluid; and a controller configured to:

provide an electrical current into the first coil;

measure an electrical property of the first coil, wherein the measured electrical property is based on the magnetic material in magnetic communication with the first coil; and determine a wear state of the downhole tool based on the measured electrical property.

16. The downhole monitoring system of claim 15, wherein the controller is configured to provide an electrical current to the second coil and compare the measured electrical property of the first coil with a measured electrical property of the second coil.

17. The downhole monitoring system of claim 15, wherein the first magnetic material is arranged on an upstream side of the sacrificial electrical sensor element relative to a flow of the fluid in the borehole and the second magnetic material is arranged on a downstream side of the sacrificial electrical sensor element relative to the flow of the fluid in the borehole.

18. The downhole monitoring system of claim 15, wherein the second magnetic material is arranged within the downhole tool.

19. The downhole monitoring system of claim 15, wherein the controller includes a first oscillator circuit electrically connected to the first coil, a second oscillator circuit electrically connected to the second coil, and a frequency comparison unit configured to compare a frequency measurement from the first oscillator circuit and the second oscillator circuit.

20. The downhole monitoring system of claim 15, wherein the electrical property is at least one of a magnetic flux of the at least one coil or a voltage and a phase of an electrical signal of the at least one coil.

* * * * *